US005486009A

United States Patent [19]

Browne

[11] Patent Number: 5,486,009

[45] Date of Patent: Jan. 23, 1996

[54] SLAMMER FOR USE IN PLAYING MILK CAP TYPE GAMES AND METHOD OF MANUFACTURE

[75] Inventor: Bruce Browne, Bonita, Calif.

[73] Assignee: B and P Plastics, National City, Calif.

[21] Appl. No.: 418,774

[22] Filed: Apr. 7, 1995

Related U.S. Application Data

[63] Continuation of Ser. No. 394,891, Feb. 27, 1995, Pat. No. 5,443,106, which is a continuation-in-part of Ser. No. 305, 437, Sep. 13, 1994, Pat. No. 5,421,488.

[51] Int. Cl.[6] ..... A63B 65/10

[52] U.S. Cl. ..... 273/424

[58] Field of Search ..... 273/57.2, 108, 273/126 R, 128 R, 424, 425, 288, 289, 290, 291

[56] References Cited

U.S. PATENT DOCUMENTS

| | | | |
|---|---|---|---|
| 4,019,747 | 4/1977 | Chuilli | 273/239 |
| 4,172,597 | 10/1979 | Smith et al. | 273/269 X |
| 4,676,509 | 6/1987 | Bishop | 273/239 |
| 5,340,113 | 8/1994 | Respicio | 273/249 |

*Primary Examiner*—William E. Stoll

*Attorney, Agent, or Firm*—John R. Duncan; Frank D. Gilliam

[57] ABSTRACT

A slammer for use in the game generally called milk caps or pogs, originally played with milk bottle caps. The slammer is basically a disk shaped member having at least one metal disk, which preferably has a central aperture. The disk or disks are encapsulated in a synthetic resin housing. A first cylindrical housing portion is formed around the metal disk or disks by injection molding of a tough synthetic resin, with a disk surface at one face of the housing. A second housing portion is formed by injection molding of a second synthetic resin over the exposed disk assembly surface. The second resin is softer than the first resin and preferably bears finger tip shaped depressions to provide an optimum gripping surface for holding and throwing the slammer during game play. In a preferred embodiment, a plurality of thin, apertured metal disks, generally 2 to 4, are stacked and a resin plug is formed within the aligned apertures to hold the disks together. The resulting disk assembly is then encapsulated as described above.

10 Claims, 1 Drawing Sheet

SLAMMER FOR USE IN PLAYING MILK CAP TYPE GAMES AND METHOD OF MANUFACTURE

CROSS REFERENCE TO RELATED APPLICATIONS

This application is a continuation of U.S. patent application Ser. No. 08/394,891 filed Feb. 27, 1995, now U.S. Pat. No. 5,443,106 which is a continuation-in-part of U.S. patent application Ser. No. 08/305,437 filed Sep. 13, 1994, now U.S. Pat. No. 5,421,488.

BACKGROUND OF THE INVENTION

This invention relates in general to implements used in playing the game generally known as "milk cap" or "pog" and, more specifically, to an improved slammer for use in that game and a method of making the slammer.

Within the last few years, a game was conceived by unknown persons in Hawaii. The game used conventional disk-shaped cardboard milk and juice bottle caps as game disks. The players stack a number, generally four or more, game disks which bear indicia indicating a "front" side. One player then throws another disk, called a "slammer" or "hitter", generally similar in diameter to the game disks, but thicker and heavier, against the top of the stack. All game disks knocked off of the stack that land backside up are kept by the player. The game disks that landed frontside up are restacked and the same player continues until the player is unsuccessful in flipping over any game disks. The turn then passes to the next player. In one alternative method of play, players alternate turns. Play continues until all game disks are flipped over. The player with the most game disks at the end of the game wins. A number of different variations on the game have been developed.

This the bottle cap-like disks are often called Pogs. Apparently the name derives from a Hawaiian juice drink called POGS for the constituent passion fruit, orange and guava juices. The caps to the Pogs drink bottles were among the earliest game disks.

With the rapid growth of interest in the game, a number of manufacturers have produced bottle cap-like game disks and a variety of different slammers. The game disks are generally made from cardboard or plastic and simulate bottle caps in diameter and thickness, generally including a cutout simulating the tab used for removing the original bottle caps from bottles.

While slammers were originally simply another cap, slammers now tend to be a heavier material, such as metal, having a diameter generally the same as the game disks but somewhat thicker. The metal slammers have square edges and sometimes have serrated edges to better catch against the game pieces. Unfortunately, when the slammer bounces off of the stack of game pieces it may strike the player or a bystander, inflicting cuts, bruises or other injuries.

Slammers generally have a slick metal surface which may be embossed with any of a variety of designs. Since the slammers is thrown with considerable force and accuracy is required to properly strike the stack of game disks, having the slammer slip from the player's fingers is undesirable.

Metal slammers from a manufacturer tend to be all identical so that those belonging to different players are difficult to identify and may become mixed up.

Thus, there is a continuing need for improved slammers for use in playing the game generally known as pogs which are safer is use and provide more effective play, have different appearances for ease of identification and provide greater ease of gripping and resulting greater accuracy.

SUMMARY OF THE INVENTION

The above-noted problems, and others, are overcome in accordance with this invention by a slammer for use in the game generally know as "pogs" which basically comprises at least one metal disk, the disk or disks having a diameter less than the selected diameter of the slammer, said metal disk or disks housed in a synthetic resin material housing having a generally circular edge and two opposed generally parallel faces, the material on at least one face being relatively softer and more resilient.

The metal disks preferably have a central aperture, although disks without apertures may be used. In the case where a plurality of disks in face-to-face contact are used, a synthetic resin plug is formed within the central apertures to bind the disks together as an assembly and resist separation of the disks within the housing. A single disk, with or without an aperture, or a bound set of disks may be held in a mold for injection molding by any suitable means, such as magnets.

Optimally, two spaced depressions are formed in the softer face material to provide an excellent gripping surface to two fingers when throwing the slammer. The second face is bonded to the metal disk face and edge material by any suitable means, such as injection molding, thermal bonding, adhesive bonding, etc.

The synthetic resins used may incorporate any suitable additives, such as fillers, colorants or the like. Typically, the two resins used will be brightly colored and may include two different colors to help distinguish slammers used by two or more players. Further, the surface of the slammer can bear any suitable indicia, such as a hot stamped foil logo.

The slammer of this invention may have any suitable weight and dimensions. The diameter is generally from about 1.5 to 2 inches, with 1⅝ inches often being considered "standard" for the game. Thickness may vary from about ⅜ to ¾ inch.

It is, therefore, an object of this invention to provide an improved slammer which can more effectively be used in playing the "pogs" game. Another object is to provide a slammer having a softer surface relative to metal for increased safety in use. A further object is to provide a slammer that can be more easily gripped and controlled in use. Still another object is to provide a variety of slammers having colorful, attractive, distinctive, appearances. Yet another object is to provide a simple and effective method of manufacturing improved composite slammers. A still further object is to provide a method of making slammers which permits the weight of the slammer to be easily varied and selected during manufacture.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
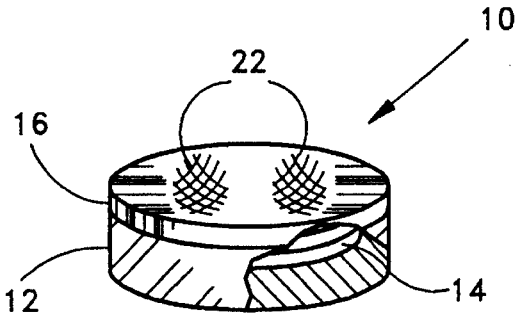
FIG. 1 is a perspective view, partially cut-away, of a first embodiment the slammer of this invention.
Figure 2:
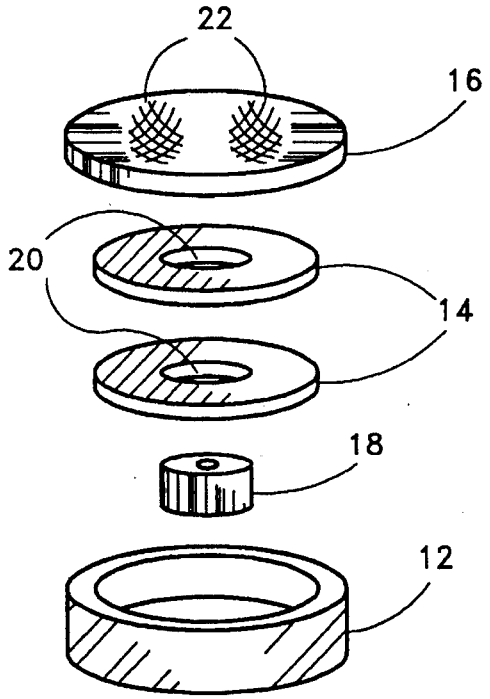
FIG. 2 is an exploded view of the slammer of FIG. 1.

A partially cut-away perspective view of the slammer of this invention is shown in FIG. 1. The slammer 10 of FIG. 1 is shown in exploded form in FIG. 2 to reveal internal components.

Slammer 10 is generally disk shaped, comprising a lower or first housing portion 12 which surrounds the lower surface and edges of one or more metal disks 14. In the embodiment illustrated, two apertured disks are shown in a face to face arrangement. An upper or second housing portion 16 is formed over the upper surface of the assembly of metal disks 14 and first housing portion 12 and is bonded thereto.

Disks 14 may be formed from any suitable material providing the desired weight characteristics and may have any suitable dimensions. Each disk 14 generally has a diameter of from about 0.75 to 1.5 inches and thicknesses of about 1/16 to 3/8 inches, with several being stacked if desired. Where used, the central metal disk aperture is generally from about 1/4 to 3/4 inch. Overall, the weight of a disk should be from about 30 to 120 grams for best results. Each disk 14 may have a smooth surface or may be embossed or roughened to aid in adhesion to the housing material.

For best results, a metal such as iron, steel, brass or any combination thereof is preferred. The number of disks used will depend upon the weight desired. While from 1 to 6 disks 14 could be used, for best results 1 to 4 disks are preferred. The use of thin disks, with selected numbers of disks stacked to give different slammer characteristics, is preferred over using disks of different thickness since the weight of different slammers may be easily varied and selected without a need for stocking a variety of disks of different thickness.

Where a disk has a central aperture, plug 18, preferably formed from a synthetic resin, is pressed into apertures 20 of disks 14 with the disks in tight, face-to-face, contact. When the flat ends of plug 18 are pressed, the plug material expands towards the walls of apertures 20 to tightly engage those walls. This binds the two disks 14 together and prevents separation of the disks within housings 12 and 16 during play. In another embodiment, an apertured disk may be placed in a mold and the first housing portion 12 and a plug 18 within the aperture may be formed simultaneously.

A pair of spaced, finger tip shaped, depressions 22 are preferably formed in the outer surface of upper housing portion 16 to aid in gripping slammer 10 with the tips of two fingers for improved control and accuracy in throwing the slammer.

Each of the first and second housings 12 and 16 may be formed from any suitable synthetic resin. For optimum griping, it is preferred that the second housing portion 16 be formed from a softer, more resilient, material than that used in first housing portion 12.

Any suitable synthetic resin material may be used for the housings 12 and 16 and plug 18 (if used). Typical plastic material include polyolefins such as polyethylene and polypropylene, acrylic resins, vinyl resins, polyvinyl chloride, ethylene vinyl acetate, acetate elastomers, acrylonitrile-butadiene-styrene and copolymers and blends thereof. For an optimum combination of strength and resistance to damage with maximum "feel" and grip characteristics, it is preferred that the metal disks 14 be embedded in first synthetic resin housing 12, with the metal disk surface flush with the material forming one face and the circular edge, the resin having high impact resistance and toughness, such as a polyolefin, tough elastomers, crystalline polymers or mixtures and blends thereof. A particularly suitable first resin is available from DuPont under the Eluax designation.

The second housing portion 16 covers the metal disk face and the edges of the first housing and is preferably formed from a softer, more resilient, second resin, such as a soft vinyl or polyvinyl chloride material, and mixtures or blends thereof. An optimum material is available from Juon Compounding Solutions under the Hercuprene designation. This second material bonds well to the preferred first resin materials by thermal bonding methods.

Where used, plug 18 is preferably formed from a tough synthetic resin material which can be pressed into apertures 20 and will strongly bind plural disks 14 (where used) together into a unitary assembly. Preferred materials include hard, tough plastics, such as styrene, polyolefins, acrylonitrile-butadiene-styrene and copolymers and blends thereof.

In an optimum method of manufacturing the slammers of this invention, initially a selected number of disks 14 are stacked to give the desired weight. A generally cylindrical plug 18 having a diameter slightly less than the diameter of apertures 20 and a height greater than the height of the disk stack is inserted into the aligned apertures 20. Plug 18 is pressed in a conventional press along directions perpendicular to the plane of the disks to cause the plug to shorten and radially expand into tight, binding, contact with the wall of apertures 20. While this method is preferred for simplicity, positive binding and resistance to cracking or other separation, if desired a apertures 20 could be filled with a plug formed from a liquid adhesive, such as an epoxy glue, or the plug could be formed by injection molding.

Next, the assembly of disks 14 and plug 18 is placed on one flat wall of a short cylindrical injection mold. The resin forming first housing portion 12 is then injected into the mold. The resulting preform has the disk assembly exposed at one face with the other face and assembly edges uniformly covered with the resin.

The preform is place in a second cylindrical injection mold having a diameter equal to the preform diameter, but greater depth, leaving a disk-shaped cavity over the exposed disk assembly face. The wall opposite the preform is configured to produce depressions 22. The resin forming the second housing portion 16 is injected and thermally bonds with the first housing portion material around the edges of the disk assembly and with the disks and plug.

Figure 3:
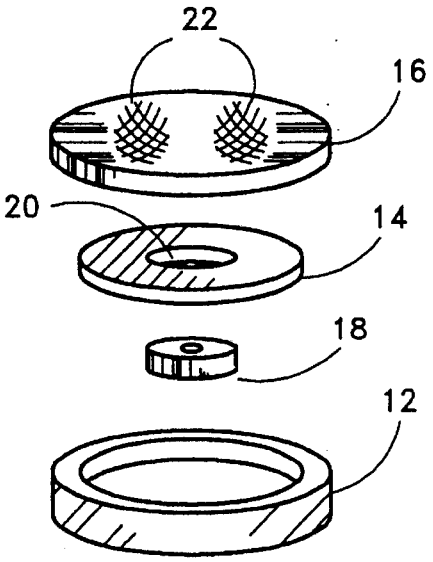
FIG. 3 is an exploded views of a second embodiment of the slammer.

FIG. 3 illustrates a second embodiment in which one or more disks 14 are stacked in an injection mold and held in place by a small amount of a tacky adhesive, a magnet, etc. The mold is filled by conventional injection molding methods, forming a preform of first housing 12 surrounding disk 14 and filling the aperture 20 in disk 14, with the disk at one face of the first housing preform. The second housing portion 16 is then injection molded as described above, preferably with finger tip depressions 22 formed in the outer surface.

Figure 4:
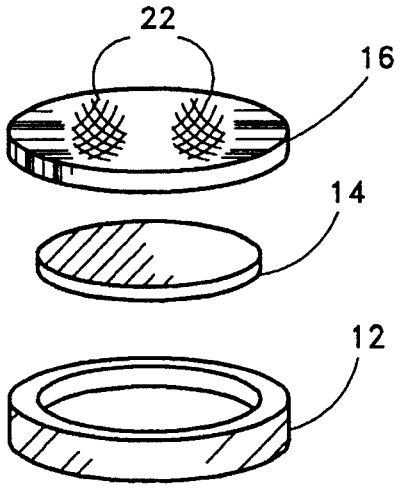
FIG. 4 is an exploded view of a third embodiment of the slammer.

A third embodiment is illustrated in FIG. 4. In this method, the steps described in conjunction with the description of FIG. 3 are repeated, except that disk 14 does not include an aperture 20. Disk is embedded in one surface of first housing portion 12, then second housing portion 16 is formed thereover and bonded thereto.

As mentioned above, the material used to form second housing portion 16 is preferably softer than that forming the first housing portion, so that an optimum gripping surface is provided at depression 22 while maintaining optimum impact resistance in the areas covered by the first housing portion material.

Each of the two housing portions may be brightly colored with suitable dyes or pigments. Where the two portions have different colors, it is possible to provide a very large number of different color combinations, so that players can easily distinguish their slammers from those used by others.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A slammer for playing Milk Caps type games, which comprises:

one apertured metal disk a first synthetic resin housing portion surrounding a first face of said disk and the outer edges of said disk;

a second synthetic resin housing portion coveting the second face of said disk;

said second housing portion being formed from a softer resin than the resin forming said first housing portion.

2. The slammer according to claim 1 wherein two spaced, generally finger tip shaped, depression are formed in a surface of said second housing portion.

3. The slammer according to claim 1 where said disk has a central aperture and further including a synthetic resin plug filling said central aperture and binding said metal disk to said housings.

4. The slammer according to claim 1 wherein said metal disk has a diameter of from about ¾ to 1½ inches, a thickness of from about 1/16 to ⅜ inch and said aperture has a diameter of from about ⅛ to ¾ inch.

5. The slammer according to claim 1 wherein said first housing portion is formed from a synthetic resin selected from the group consisting of ethylene vinyl acetate, polyolefins, polycarbonate and copolymers and mixtures thereof.

6. The slammer according to claim 1 wherein said second housing portion is formed from a synthetic resin selected from the group consisting of vinyl, polyvinyl chloride and copolymers and mixtures thereof.

7. A slammer for playing Milk Caps type games, which comprises:

a metal disk having a generally central aperture;

a first synthetic resin housing portion surrounding a first face of said disk assembly and the outer edges of said disk assembly;

a second synthetic resin housing portion coveting the second face of said disk assembly; and two spaced, generally finger tip shaped, depressions formed in a surface of said second housing.

8. The slammer according to claim 7 wherein each metal disk has a diameter of from about ¾ to 1½ inches, a thickness of from about 1/16 to ⅜ inch and said central aperture has a diameter of from about ⅛ to ¾ inch.

9. The slammer according to claim 7 wherein said first housing portion is formed from a synthetic resin selected from the group consisting of ethylene vinyl acetate, polyolefins, polycarbonate and copolymers and mixtures thereof.

10. The slammer according to claim 7 wherein said second housing portion is formed from a synthetic resin selected from the group consisting of vinyl, polyvinyl chloride and copolymers and mixtures thereof.

* * * * *